US006431654B1

(12) United States Patent
LeBegue

(10) Patent No.: US 6,431,654 B1
(45) Date of Patent: Aug. 13, 2002

(54) MINING MACHINE HAVING AN EXTENDABLE AND RETRACTABLE ROTOR ARM AND METHOD OF REPAIRING AN EXTENDABLE AND RETRACTABLE ROTOR ARM ASSEMBLY

(75) Inventor: Maurice K. LeBegue, Bluefield, WV (US)

(73) Assignee: Eimco LLC, Bluefield, WV (US)

( * ) Notice: Subject to any disclaimer, the term of this patent is extended or adjusted under 35 U.S.C. 154(b) by 0 days.

(21) Appl. No.: 09/612,912

(22) Filed: Jul. 10, 2000

(51) Int. Cl.[7] ..... E21C 25/08

(52) U.S. Cl. ..... 299/61; 299/10; 299/80.1; 403/356; 403/367

(58) Field of Search ..... 299/55.1, 58, 59, 299/61, 80.1; 403/356, 358, 273, 367, 334

(56) References Cited

U.S. PATENT DOCUMENTS 258,698 A * 5/1882 Bissell ..... 403/252
408,835 A * 8/1889 Grafton ..... 403/358
1,849,186 A * 3/1932 Grau et al. ..... 403/202
2,879,049 A * 3/1959 Poundstone ..... 299/80.1
2,890,033 A 6/1959 Silks
2,937,859 A 5/1960 Jackson
3,309,144 A * 3/1967 Karlovsky ..... 299/60
3,516,712 A * 6/1970 Bennett et al. ..... 299/64
4,110,652 A * 8/1978 McGahern ..... 310/261
4,316,635 A 2/1982 LeBegue et al.

* cited by examiner

*Primary Examiner*—David Bagnell
*Assistant Examiner*—John Kreck
(74) *Attorney, Agent, or Firm*—Burns, Doane, Swecker & Mathis, L.L.P.

(57) ABSTRACT

An extendable rotor arm for a mining machine includes a rotor arm having an end portion, a sleeve removably secured on at least part of the end portion, a rotor arm extension having an internal opening in which the sleeve and the end portion of the rotor arm are axially slidably received and nonrotatable, and a seal between an internal surface of the internal opening of the rotor arm extension and the sleeve. Methods of repairing an extendable rotor arm for a mining machine are also disclosed.

27 Claims, 11 Drawing Sheets

MINING MACHINE HAVING AN EXTENDABLE AND RETRACTABLE ROTOR ARM AND METHOD OF REPAIRING AN EXTENDABLE AND RETRACTABLE ROTOR ARM ASSEMBLY

BACKGROUND AND SUMMARY

This invention relates to a mining machine having a rotor arm cutting assembly and more particularly to an extendable and retractable rotor arm for a boring-type mining machine and a method for repairing an extendable and retractable rotor arm.

In boring-type mining machines as illustrated in U.S. Pat. No. 2,299,593 a pair of rotor cutter arms are mounted on a pair of parallel positioned drive shafts that extend forwardly from a gear box at the front of a mining machine. Rotation of the drive shafts rotates the rotor cutter arms to cut a pair of parallel bores in a seam of coal or mineral material to dislodge the material from a mine face. A conveyor mounted on the mining machine conveys the dislodged material rearwardly from the mine face for subsequent conveyance of the material from the mine. Also associated with the rotor cutter arms are cutter bars also mounted on the gear box above and below the rotor cutter arms. The cutter bars include orbitally movable chains that dislodge the cusps depending from the mine roof and upstanding from the mine floor formed by the boring action of the rotor cutter arms.

U.S. Pat. No. 2,937,859 discloses a boring-type mining machine that includes a rotor cutter arm having a base member and a cutter carrier member. The cutter carrier member fits over the base member to telescope relative to the base member. A piston cylinder assembly positioned in the base member is secured at one end to the base member and at the opposite end to the cutter carrier member. Actuation of the piston cylinder assembly shifts the cutter carrier member on the base member from a retracted position to an extended position.

A common form of extendable rotor arm for mining machines includes a rotor arm having an end portion, a rotor arm extension having an internal opening in which the end portion of the rotor arm is axially slidably received and nonrotatable, and a seal between an internal surface of the internal opening of the rotor arm extension and the rotor arm. The internal opening of the rotor arm extension is non-circular and an external portion of the end portion of the rotor arm is non-circular such that the rotor arm extension is axially slidable and nonrotatable relative to the sleeve and the end portion of the rotor arm. The end portion of the rotor arm typically includes a key arrangement removably secured thereto, the key arrangement defining at least part of the non-circular external portion.

The portion of the rotor arm in contact with the seal is typically a metal casting that is chrome plated to assist in the sealing function. During operation, the chrome plating is subject to wear. Repair of the chrome plating is a time consuming and difficult task. It is desirable to provide a sealing arrangement in an extendable rotor arm assembly that is relatively easy and quick to repair or replace.

Another problem with prior art extendable rotor arm assemblies is that the forces on the rotor arm extension cause the key arrangement to wear. It is desirable to provide a key arrangement that is relatively easy and quick to repair or replace.

The mining machine, extendable and retractable rotor arm, and method of repairing an extendable and retractable rotor arm according to the present invention permit the foregoing problems with prior art mining machines to be overcome.

According to one aspect of the present invention, an extendable rotor arm for a mining machine includes a rotor arm having an end portion, a sleeve removably secured on at least part of the end portion, a rotor arm extension having an internal opening in which the sleeve and the end portion of the rotor arm are axially slidably received and nonrotatable, and a seal between an internal surface of the internal opening of the rotor arm extension and the sleeve.

According to another aspect of the present invention, a mining machine having extendable rotor arms includes a body, two or more drive shafts extending from a forward end of the body, one or more drives for rotating the drive shafts, and one or more extendable rotor arms mounted on each of the drive shafts. Each rotor arm has an end portion, a sleeve removably secured on at least part of the end portion, a rotor arm extension having an internal opening in which the sleeve and the end portion of the rotor arm are axially slidably received and nonrotatable, and a seal between an internal surface of the internal opening of the rotor arm extension and the sleeve.

According to another aspect of the present invention, a method of repairing an extendable rotor arm for a mining machine is provided. According to the method, a rotor arm extension, the rotor arm extension having an internal opening, is removed from an operating position on a rotor arm in which an end portion of the rotor arm and at least part of a sleeve on the end portion of the rotor arm are disposed inside of the internal opening of the rotor arm extension. The sleeve on the end portion of the rotor arm is replaced with a new sleeve. The rotor arm extension is replaced in the operating position on the rotor arm.

According to yet another aspect of the present invention, a method of repairing an extendable rotor arm for a mining machine is provided. According to the method, a rotor arm extension, the rotor arm extension having an internal opening, is removed from an operating position on a rotor arm in which an end portion of the rotor arm and a key on the end portion of the rotor arm are disposed inside of the internal opening of the rotor arm extension and the key is disposed in a keyway in the rotor arm extension. The key is replaced with a new key. The rotor arm extension is replaced in the operating position on the rotor arm.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
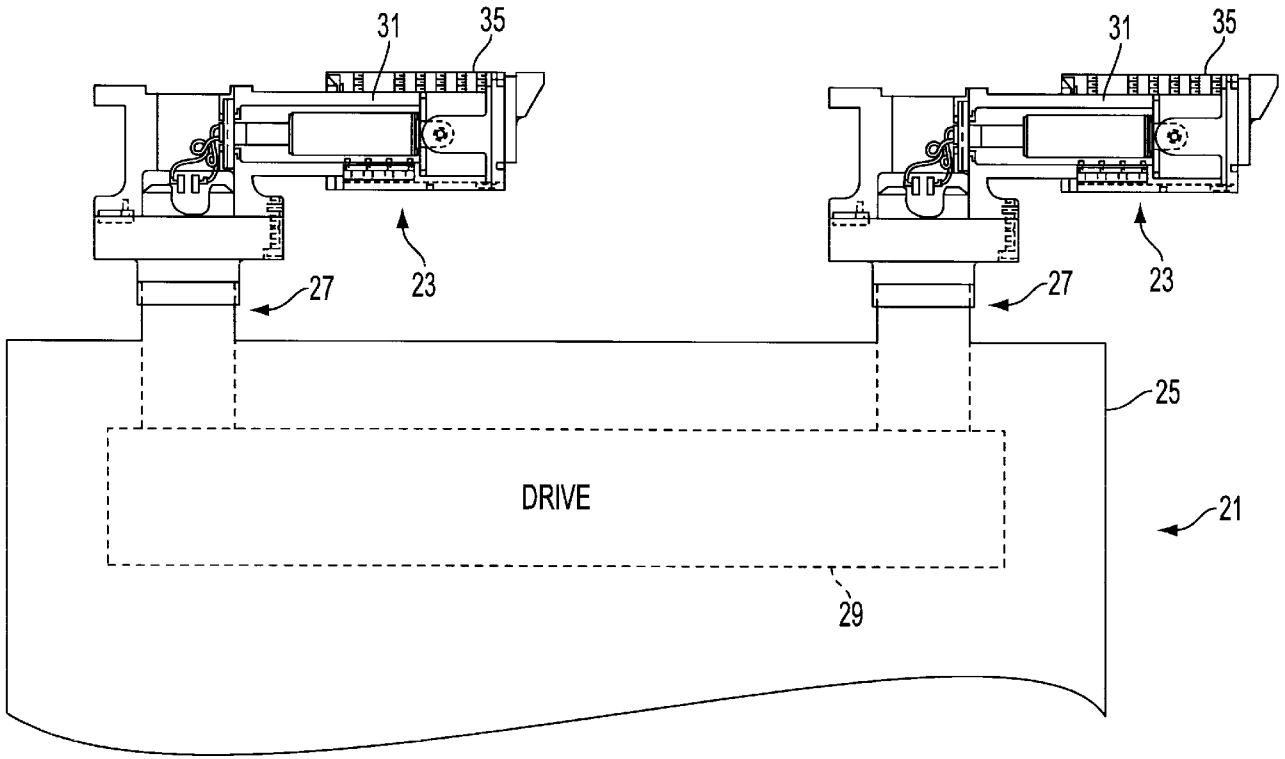
FIG. 1 is a schematic view of a mining machine including extendable rotor arms according to an embodiment of the present invention.
Figure 16:
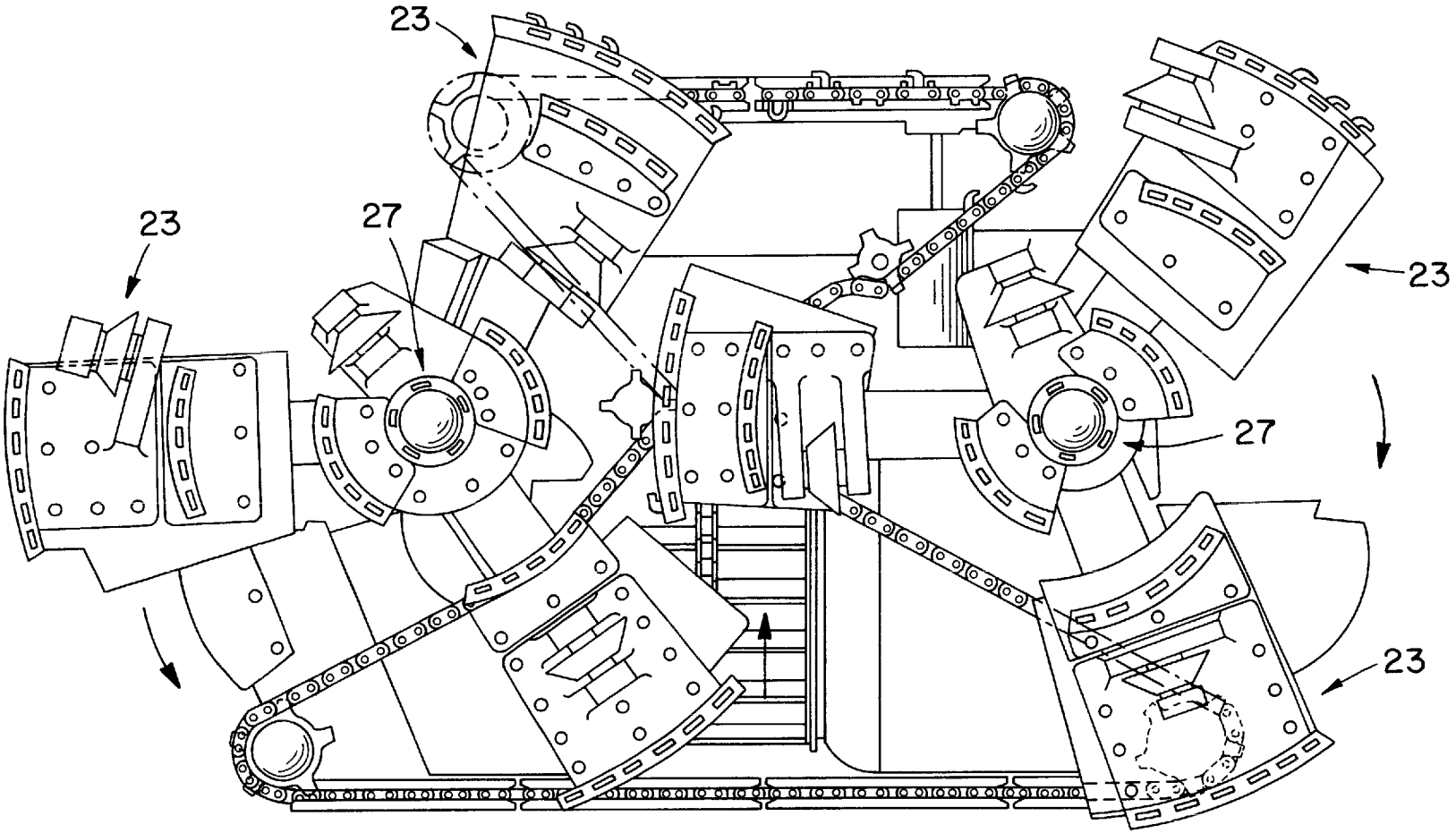
FIG. 16 is a schematic front view of a rotor according to an embodiment of the present invention.

A mining machine 21 having extendable rotor arms 23 according to an embodiment of the present invention is shown in FIG. 1. The mining machine 21 can be a conventional boring-type continuous mining machine having a body 25, two or more drive shafts 27 extending from a forward end of the body, and one or more drives 29 for rotating the drive shafts. Examples of conventional boring-type continuous mining machines are disclosed in, for example, U.S. Pat. No. 2,890,033, U.S. Pat. No. 2,937,859, and U.S. Pat. No. 4,316,635, the disclosures of which are incorporated by reference. According to the present invention, at least one and preferably a plurality of extendable rotor arms 23 are mounted on each of the drive shafts 27. A rotor with a plurality of extendable rotor arms 23 mounted on a drive shaft 27 is shown in FIG. 16.

Figure 2:
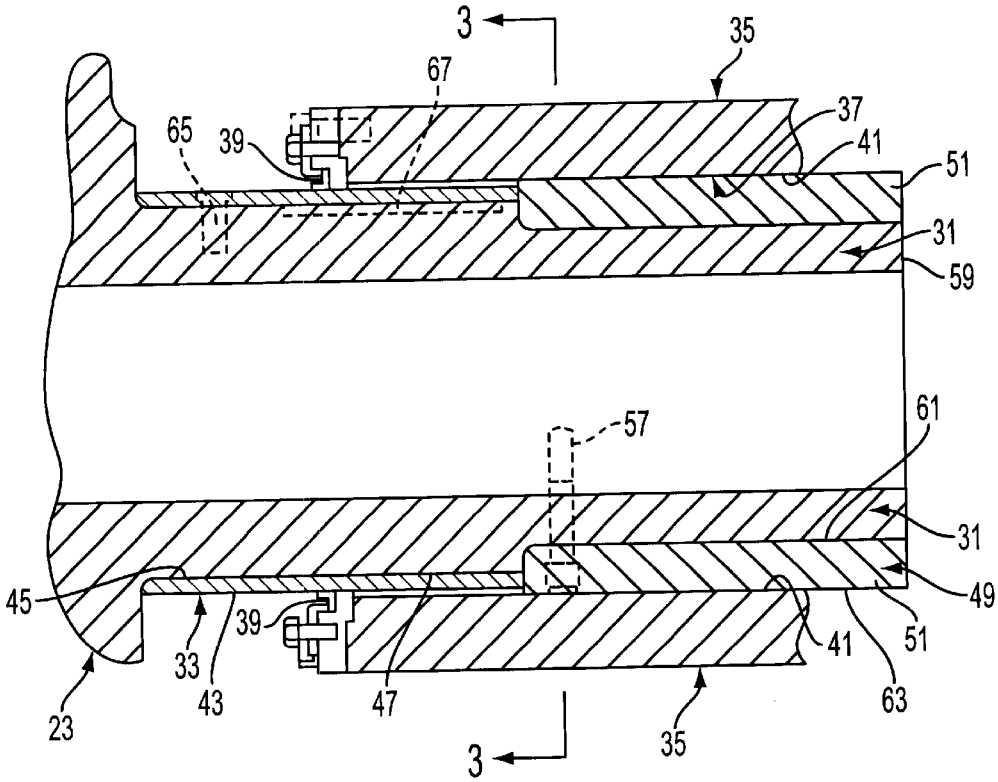
FIG. 2 is a cross-sectional side view of an extendable rotor arm according to a first embodiment of the present invention.

As seen in FIG. 2, each rotor arm 23 has an end portion 31, a sleeve 33 removably secured on at least part of the end portion, a rotor arm extension 35 having an internal opening 37 in which the sleeve and the end portion of the rotor arm are axially slidably received and nonrotatable, and a seal 39 between an internal surface 41 of the internal opening of the rotor arm extension and the external surface 43 of the sleeve. The sleeve 33 is preferably a stainless steel sleeve and is provided where, in the past, the end portion 31 of the arm was chrome plated to facilitate the seal between the end portion of the arm and the internal opening 37 of the rotor arm extension 35. The sleeve 33 is preferably shrink fit around the end portion 31 of the rotor arm 23 to secure it in place, and may be further secured in place by means such as bolts. In addition, the sleeve 33 preferably has an internal surface 45 that is non-circular and nonrotatable relative to a corresponding non-circular external surface 47 of the end portion 31.

To prevent rotation of the rotor arm extension 35, at least a portion of at least one of the external surface 43 and/or 47 of at least one of the sleeve 33 and the end portion 31 of the rotor arm is non-circular such that the rotor arm extension is axially slidable and nonrotatable relative to the sleeve and the end portion of the rotor arm. The sleeve 33 preferably does not play a substantial role in preventing rotation of the rotor arm extension 35 because it defines a space with the internal surface 41 of the internal opening 37 in which the seal 39 is disposed. The rotor arm 23 is preferably generally circular in cross-section but at least the end portion 31 of the rotor arm preferably includes a key arrangement 49 that is preferably removably secured thereto so that the end portion of the rotor arm together with the key arrangement forms a non-circular shape in cross-section taken perpendicular to the axis of the rotor arm. The rotor arm 23 may, if desired or necessary, be a variety of shapes other than generally circular in cross-section to further assist in preventing rotation of the rotor arm extension 35 relative to the rotor arm. If desired or necessary, the key arrangement 49 may be fixed to the end portion 31, such as by welding or machining of the rotor arm 23. The key arrangement 49 defines at least part of the non-circular external surface 47 of the end portion of the rotor arm.

The key arrangement 49 preferably includes a plurality of keys 51 removably secured to the rotor arm 23 at its end portion 31. The keys 51 preferably define a polygonal shape having three or more major sides, although the keys may, if desired or necessary, define other non-circular shapes suitable for preventing rotation but defining no more than one or two surfaces. According to a presently preferred embodiment shown in FIG. 3, the keys 51 define a substantially rectangular or square shape. The shape of the rectangle defined by the keys 51 may be large enough to completely surround the end portion 31 of the rotor arm 23 or, as shown in FIG. 3, may be shorter than a diameter of the rotor arm.

The key arrangement 49 is preferably removably secured to the rotor arm 23 by a shrink fit. For example, as seen in FIG. 3, the end portion 31 of the rotor arm 23 is preferably machined to fit into a recess 53 formed in the keys 51. During assembly, the keys 51 are heated to a sufficient temperature such that the recess 53 expands from its dimensions at its normal operating temperature range to a size large enough to receive the machined protrusions 55 on the end portion 31 of the rotor arm 23. When the keys 51 cool, the recess 53 contracts to secure the keys relative to the end portion 31 of the rotor arm. If desired or necessary, bolts 57 (shown in phantom) or other mechanical fasteners may be used in addition to or instead of a shrink fit to secure the keys 51 to the end portion 31 of the rotor arm.

Figure 4:
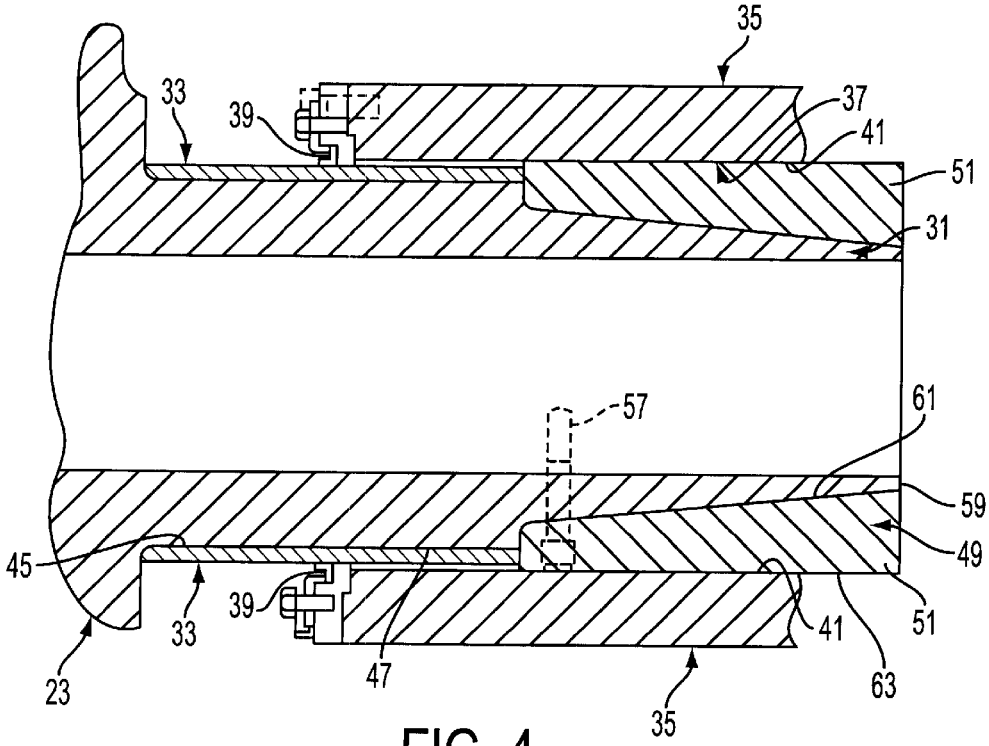
FIG. 4 is a cross-sectional side view of an extendable rotor arm according to a second embodiment of the present invention.
Figure 5:
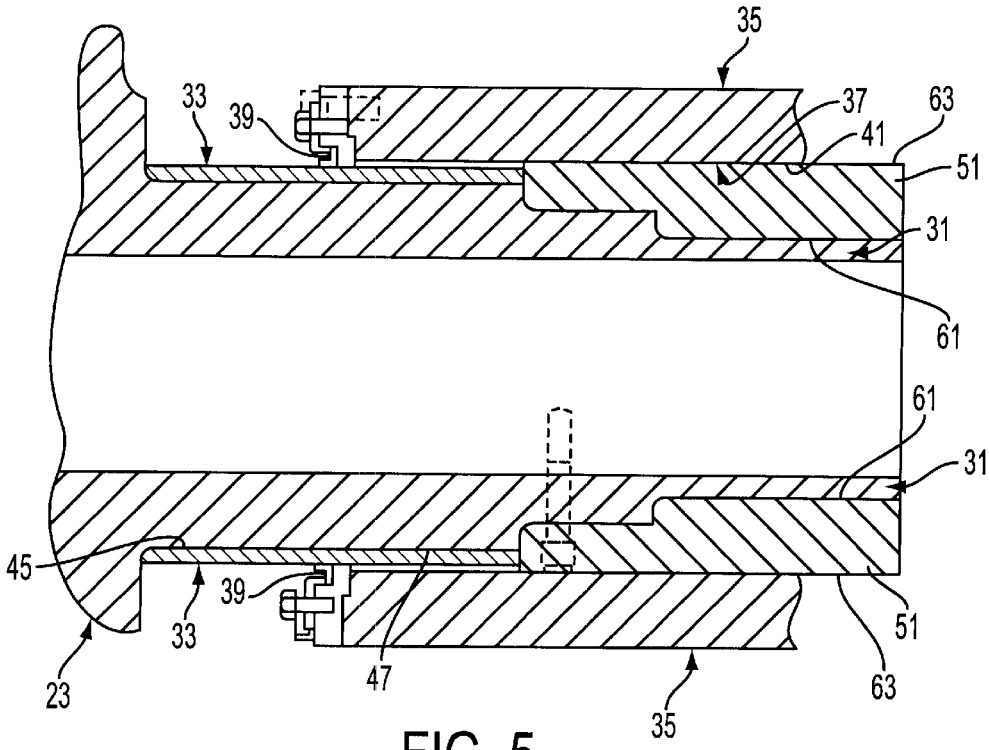
FIG. 5 is a cross-sectional side view of an extendable rotor arm according to a third embodiment of the present invention.
Figure 6:
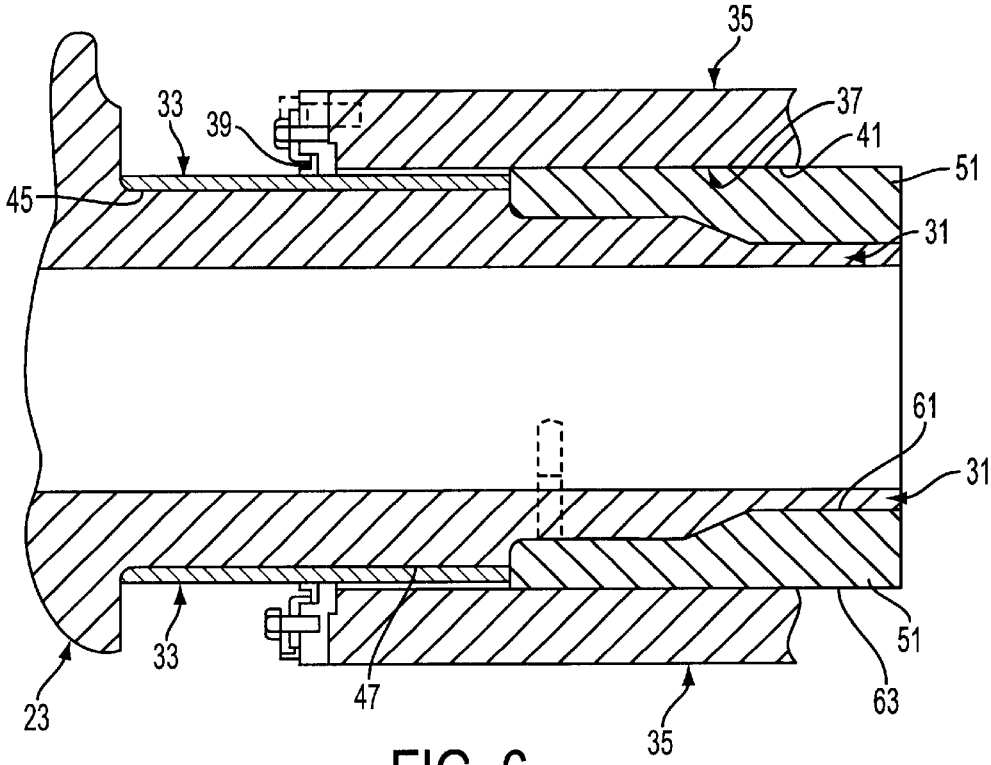
FIG. 6 is a cross-sectional side view of an extendable rotor arm according to a fourth embodiment of the present invention.

The end portion 31 of the rotor arm 23 may be a substantially straight cylinder (FIG. 2) or some other suitable shape, such as conical (FIG. 4), stepped (FIG. 5)) to decreasing diameters in an axial direction toward a distal end 59 of the end portion, or some combination of straight cylinder, and/or conical cylinder, and/or stepped cylinder (FIG. 6). When the external surface 47 of the end portion 31 is conical or stepped such that it has an inclination toward the distal end 59 of the end portion, the internal surface(s) 61 of the keys 51 is preferably also inclined so that the external surface(s) 63 of the keys are substantially parallel to an axis of the rotor arm 23 and the internal surface 41 of the internal opening 37 of the rotor arm extension 35 is substantially parallel to the axis of the rotor arm. The external surface 43 of the sleeve 33 will ordinarily be a substantially straight cylinder shape, i.e., parallel to the axis of the rotor arm but not necessarily circular, so that the seal 39 on the rotor arm extension 35 contacts the external surface of the sleeve. The embodiments shown in FIGS. 4–6 may have keys 51 that completely surround the periphery of the end portion 31 of the rotor arm 23 or that are only cover certain areas of the periphery, such as in the embodiment of FIG. 3. When a key 51 completely surround the end portion 31, the key is preferably nonrotatable relative to the end portion by providing some suitable structures such as a noncircular internal surface of the key and a noncircular external surface of the end portion, or a separate key arrangement (not shown) between the key and the end portion.

Figure 3:
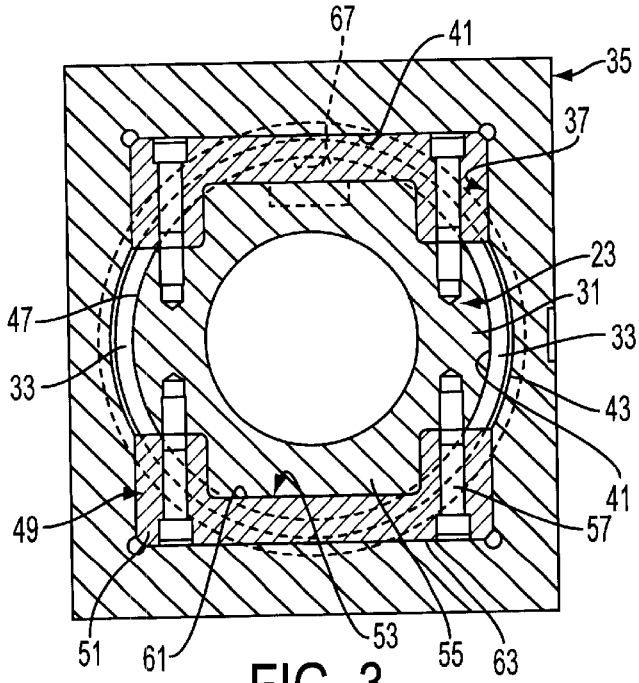
FIG. 3 is a cross-sectional view of the rotor arm of FIG. 2 taken at section 3—3 showing a first embodiment of a key arrangement according to the present invention.
Figure 7:
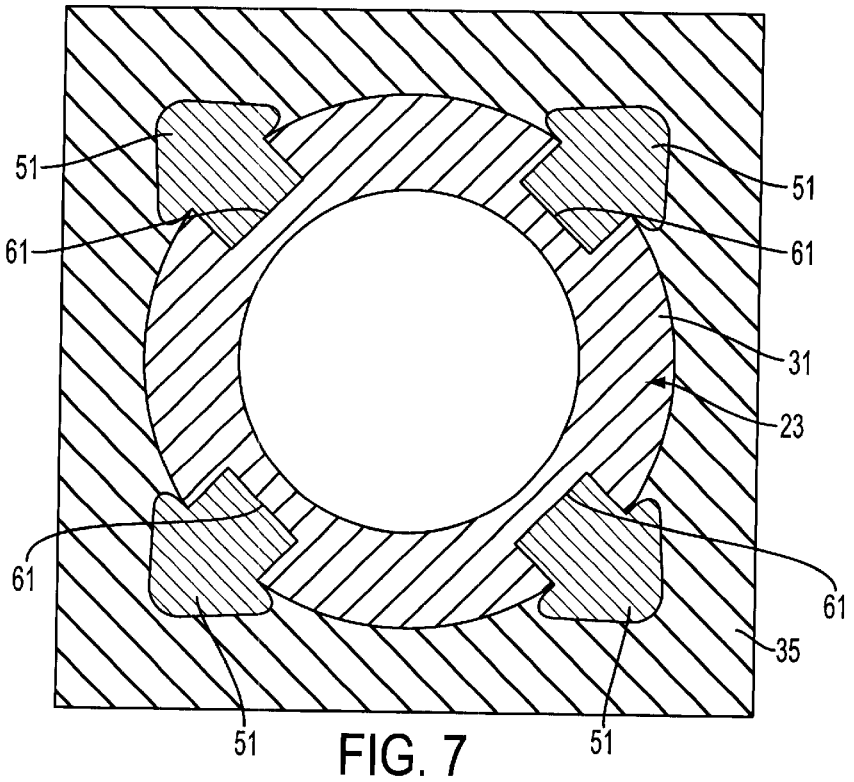
FIG. 7 is a cross-sectional view of a rotor arm according to the present invention and taken at section perpendicular to a longitudinal axis of the rotor arm and showing a second embodiment of a key arrangement according to the present invention.
Figure 8:
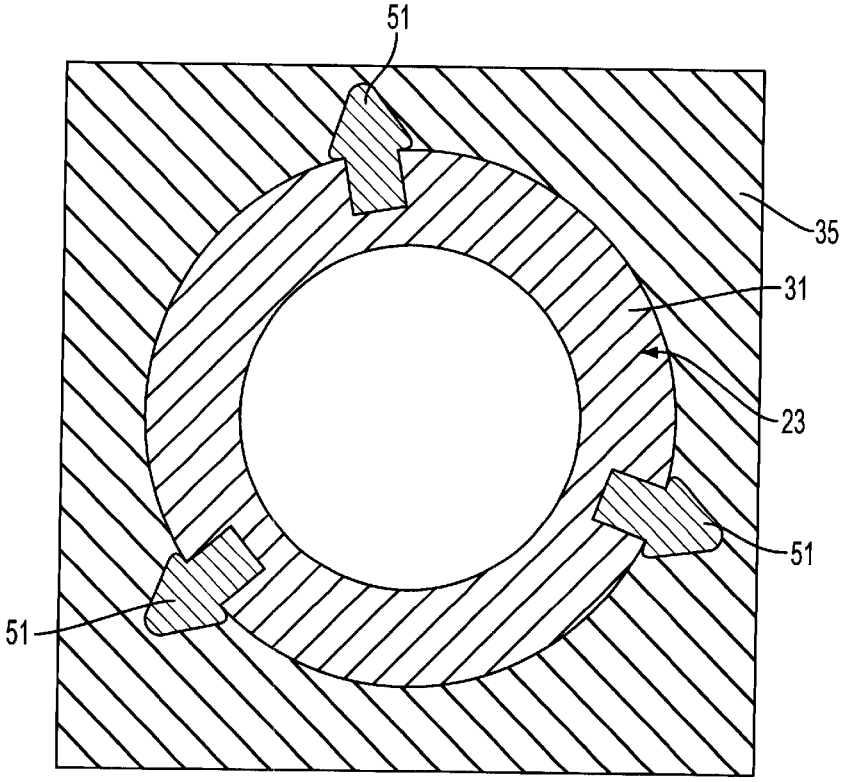
FIG. 8 is a cross-sectional view of a rotor arm according to the present invention and taken at section perpendicular to a longitudinal axis of the rotor arm and showing a third embodiment of a key arrangement according to the present invention.
Figure 9:
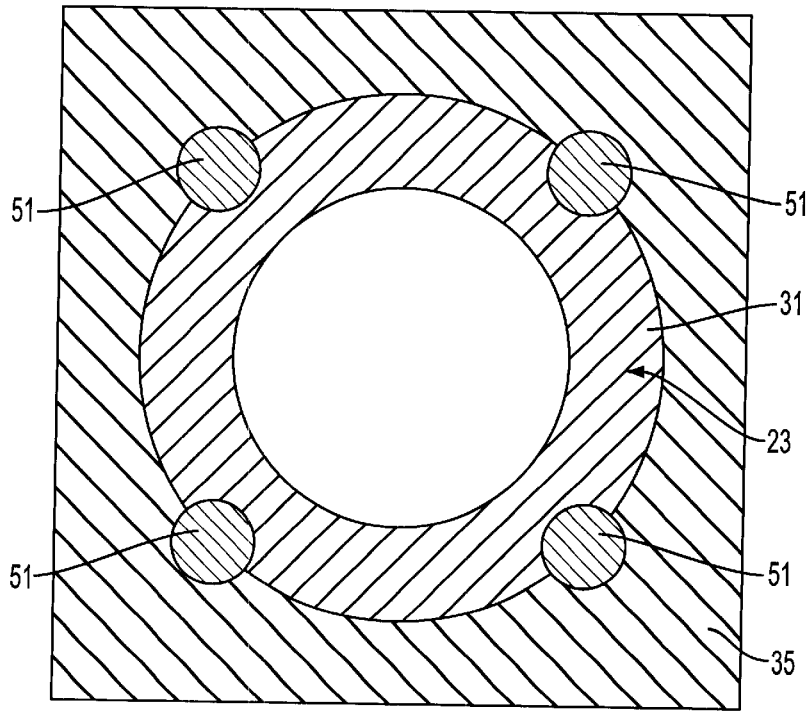
FIG. 9 is a cross-sectional view of a rotor arm according to the present invention and taken at section perpendicular to a longitudinal axis of the rotor arm and showing a fourth embodiment of a key arrangement according to the present invention.
Figure 10:
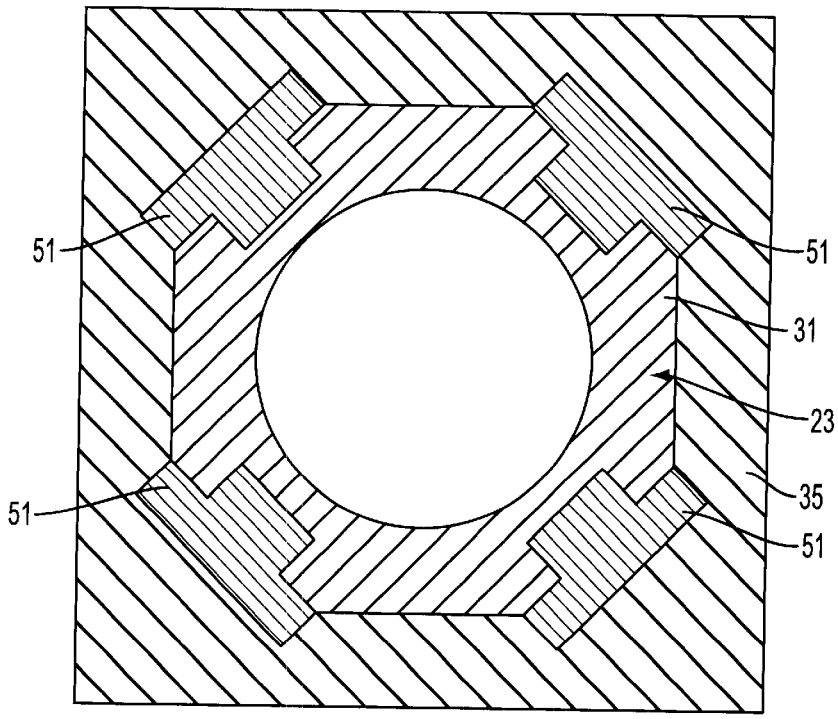
FIG. 10 is a cross-sectional view of a rotor arm according to the present invention and taken at section perpendicular to a longitudinal axis of the rotor arm and showing a fifth embodiment of a key arrangement according to the present invention.
Figure 11:
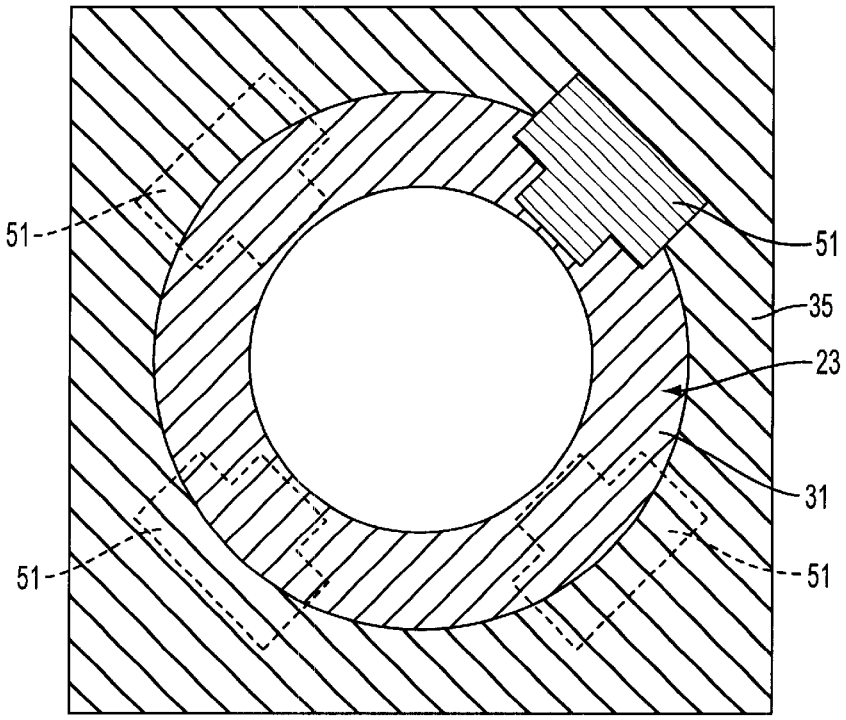
FIG. 11 is a cross-sectional view of a rotor arm according to the present invention and taken at section perpendicular to a longitudinal axis of the rotor arm and showing a sixth embodiment of a key arrangement according to the present invention.
Figure 12:
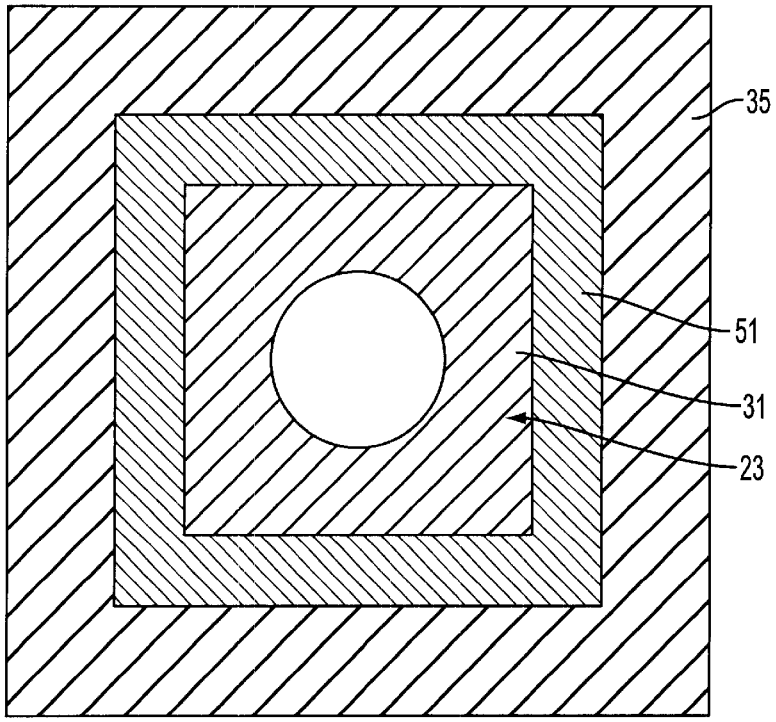
FIG. 12 is a cross-sectional view of a rotor arm according to the present invention and taken at section perpendicular to a longitudinal axis of the rotor arm and showing a seventh embodiment of a key arrangement according to the present invention.
Figure 13:
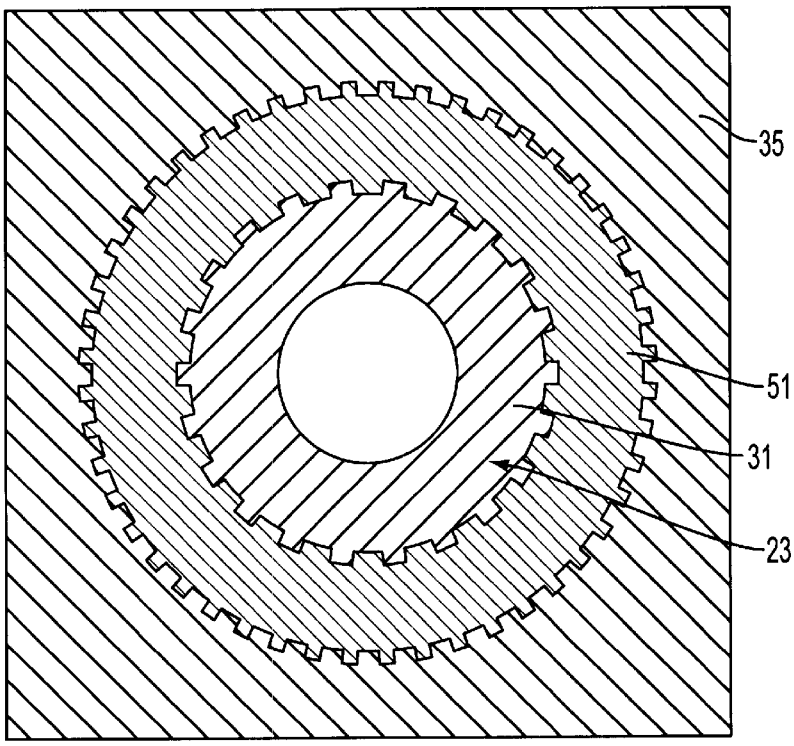
FIG. 13 is a cross-sectional view of a rotor arm according to the present invention and taken at section perpendicular to a longitudinal axis of the rotor arm and showing an eighth embodiment of a key arrangement according to the present invention.

To avoid rotation of the rotor arm extension 35 relative to the rotor arm 23, as seen in FIG. 3 at least part of the internal surface(s) 61 of the keys and the protrusions 55 or other part of the external surface 47 of the end portion 31 of the rotor arm 23 are preferably non-circular such that the keys are non-rotatable relative to the rotor arm. The keys 51 may take a variety of different forms other than that shown in FIG. 2 to achieve the desired end of being nonrotatable relative to the rotor arm 23 and preventing rotation of the rotor arm extension 35 relative to the rotor arm. For example, as seen in FIG. 7, there may be one or a plurality of keys 51 disposed at one or a plurality of angles around the axis of the rotor arm 23. The keys 51 may define a generally rectangular form as seen in FIGS. 2 and 8, a triangular form, as seen in FIG. 8, or other forms as seen in FIGS. 9–11. In addition to one or more discrete keys disposed around part of the periphery of the end portion 31, the key 51 may be in the form of a sleeve that fits around the entirety of the end portion as seen in FIG. 12. Although generally rectangular shapes for the end portion 31, the rotor arm extension 35, and the key 51 are shown in FIG. 12, the internal and externals surfaces 61 and 63 of the key may have other non-circular shapes, such as the splined shape shown in FIG. 13.

Thus far, the keys 51 have been shown as defining two or more surfaces. If desired or necessary, the external surface of the key, either alone or together with the external surface of the end portion of the rotor arm, may define a single non-circular surface, e.g., elliptical or otherwise non-circular in cross-section. Also, if desired or necessary, multiple discrete key portions may be disposed at different axial positions along the end portion of the rotor arm.

As noted above, the sleeve 33 is preferably removably secured to the rotor arm 23 by a shrink fit. The sleeve 33 may, if desired or necessary, be removably secured to the rotor arm by bolts 65 or other suitable mechanical fasteners, either alone or in combination with a shrink fit. The sleeve 33 is preferably non-rotatable relative to the rotor arm 23 such as by providing a separate key arrangement 67 (shown in phantom in FIG. 2) or otherwise making the internal surface 45 of the sleeve and the external surface 43 of the end portion 31 of the rotor arm 23 where the sleeve is intended to be secured non-circular. As with the end portion 31 of the rotor arm, the key arrangement 49, and the rotor arm extension 35 discussed above, the non-circular forms of the sleeve 33 and the end portion of the rotor arm may take many different forms.

Figure 14A:
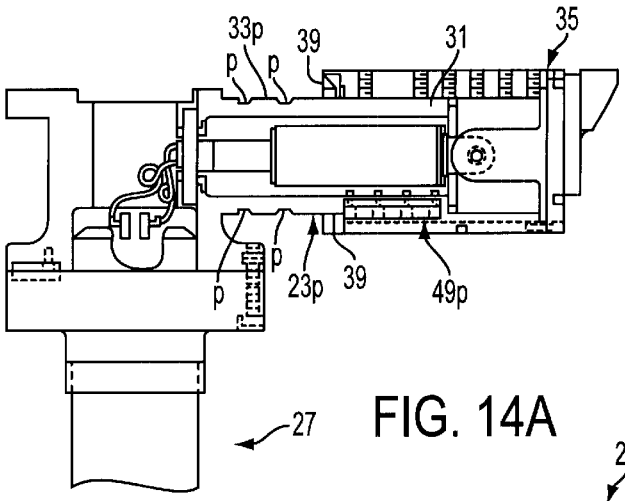
FIGS. 14A–14D show steps in a method of repairing an extendable rotor arm assembly according to an embodiment of the present invention.
Figure 14B:
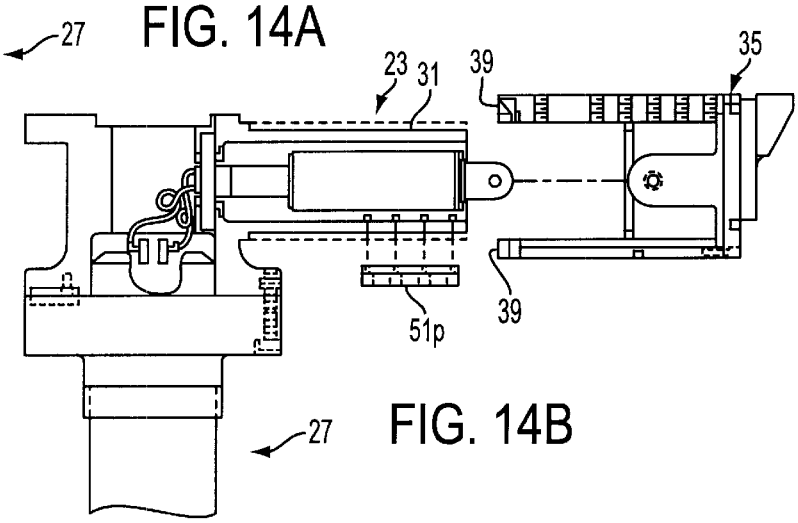
Figure 14C:
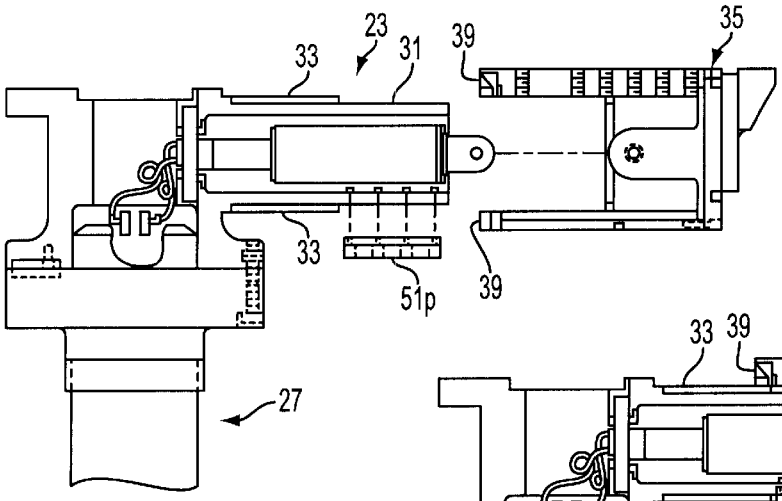
Figure 14D:
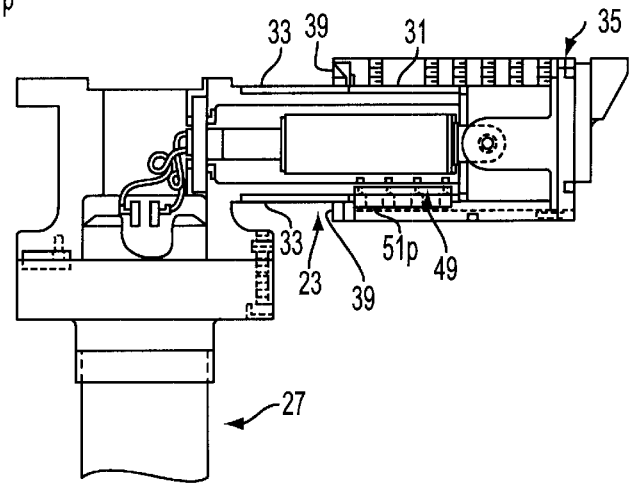

The present invention provides convenient methods of repairing an extendable rotor arm for a mining machine. One such method is described with reference to FIGS. 14A–14D. As seen in FIG. 14A, as the result of operation of a mining machine 21 having a prior art extendable rotor arm **23*p* wherein a seal 39 on the rotor arm extension 35 contacts a chrome plated portion 33*p* of the rotor arm, the chrome plating eventually becomes damaged, such as by having pits P formed therein. In the past, it was necessary to replate the rotor arm 23*p*. According to the method shown in FIGS. 14A–14D, instead of replating the rotor arm 23*p*, after removing the rotor arm extension 35 from the end portion 31 of the rotor arm 23, the rotor arm may be machined to a smaller diameter in the location of the damaged chrome plating as seen in FIG. 14B. A sleeve 33 may be fitted over the machined portion of the rotor arm as seen in FIG. 14C, and the rotor arm extension 35 may be repositioned on the rotor arm with the seal 39 in contact with the sleeve as seen in FIG. 14D. Obviously, when the sleeve 33 becomes worn, it is a relatively simple matter to replace the sleeve with a new sleeve, without the need for remachining of the rotor arm. If the extendable rotor arm 23 is provided with a sleeve 33** when new, it will not generally be necessary to machine the rotor arm when replacing the sleeve.

Figure 15A:
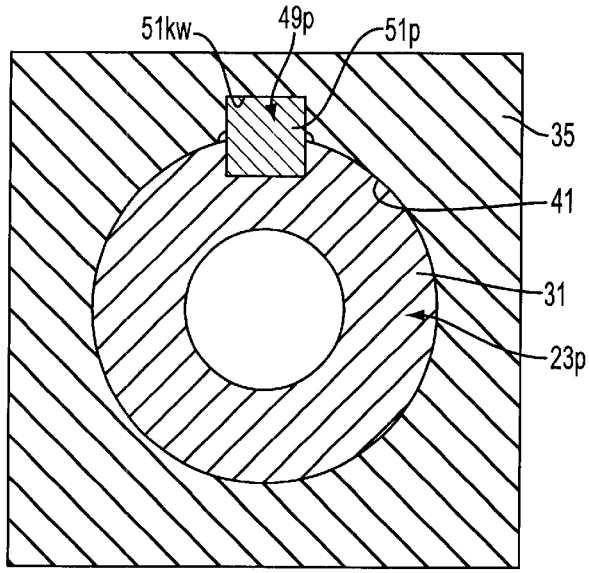
FIGS. 15A–15C show steps in a method of repairing an extendable rotor arm assembly according to an embodiment of the present invention.
Figure 15B:
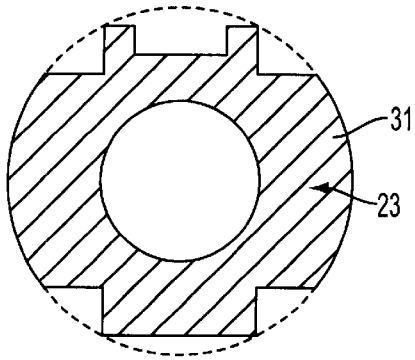
Figure 15C:
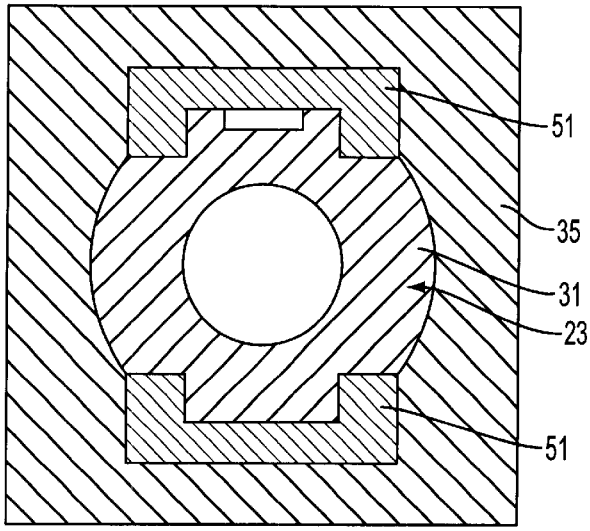

In many prior art mining machines having extendable rotor arms 23, the rotor arm extension 35 is prevented from rotation by a prior art key arrangement **49*p* that is permanently fixed to the end portion 31 of the rotor arm 23, such as by welding of keys 51*p* to the rotor arm, as seen in FIG. 15A. As the result of forces on the rotor arm extension 35, the keys 51*p* and keyways 51 kw on the internal surface 41 of the internal opening of the rotor arm extension become worn or damaged. According to prior art techniques for repairing the extendable rotor arm, the worn key 51*p* would be machined out and a new key would be welded in its place. If the keyway 51 kw was damaged, the new key 51*p* would be somewhat oversized and the keyway 51 kw would be machined to remove the damaged portion and to permit the new, oversized key 51*p* to be received in the machined keyway 51 kw. According to a further method according to the present invention, after removing a rotor arm extension and removal of an old key 51*p* as seen in FIG. 15B, the end portion 31 of the rotor arm 23 is preferably machined to be secured to a key 51 according to the present invention. As seen in FIG. 15C, the key 51 according to the present invention is preferably secured to the end portion 31 by a shrink fit, such as was discussed above with regard to FIG. 3, and/or by bolts. The rotor arm extension 35 will ordinarily also be machined to receive the new key shape. Subsequent replacements of the key 51 can be more easily performed than when it is necessary to remove prior art keys 51*p* welded to the end portion 31 of the rotor arm 23. The rotor arm extension 35 may be remachined so that its internal opening 37 receives a different form of key than was previously used, or a larger key, as is desired or necessary. Moreover, keys 51 of the same size as replaced keys may, in many circumstances, simply be attached relative to the rotor arm together with shims to permit the keys to properly fit remachined keyways in the rotor arm extension. When replacing or providing sleeves 33 as discussed above with regard to FIGS. 14A–14D, it will generally be necessary to remove any key on the end portion 31 of the rotor arm 23** before locating the sleeve in position on the rotor arm, unless the sleeve is made in several pieces that are separately secured to the rotor arm, such as by individual shrink fits and/or bolts.

While this invention has been illustrated and described in accordance with a preferred embodiment, it is recognized that variations and changes may be made therein without departing from the invention as set forth in the claims.

What is claimed is:

1. An extendable rotor arm for a mining machine, comprising:

a rotor arm having an end portion including a distal end portion;

a sleeve removably secured on part of the end portion remote from the distal end portion;

a rotor arm extension having an internal opening in which the sleeve and the end portion of the rotor arm are axially slidably received and nonrotatable, the rotor arm extension having cutting tools; and a seal disposed in a space between an internal surface of the internal opening of the rotor arm extension and the sleeve.

2. The extendable rotor arm for a mining machine as set forth in claim 1, wherein the internal opening of the rotor arm extension is non-circular and an external portion of the end portion of the rotor arm is non-circular such that the rotor arm extension is axially slidable and nonrotatable relative to the sleeve and the end portion of the rotor arm.

3. The extendable rotor arm for a mining machine as set forth in claim 2, wherein the end portion of the rotor arm includes a key arrangement removably secured thereto, the key arrangement defining at least part of the non-circular external portion.

4. The extendable rotor arm for a mining machine as set forth in claim 3, wherein the key arrangement includes a plurality of keys removably secured to the rotor arm.

5. The extendable rotor arm for a mining machine as set forth in claim 4, wherein the keys define a polygonal shape having three or more major sides.

6. The extendable rotor arm for a mining machine as set forth in claim 4, wherein the keys define a substantially rectangular shape.

7. The extendable rotor arm for a mining machine as set forth in claim 3, wherein the key arrangement is removably secured to the rotor arm by a shrink fit.

8. The extendable rotor arm for a mining machine as set forth in claim 3, wherein the key arrangement is removably secured to the rotor arm by one or more bolts.

9. The extendable rotor arm for a mining machine as set forth in claim 3, wherein the key arrangement includes one or more keys attached to a surface of the rotor arm, the surface of the rotor arm being inclined in an axial direction of the rotor arm.

10. The extendable rotor arm for a mining machine as set forth in claim 9, wherein an internal surface of the one or more keys and the inclined surface of the rotor arm are non-circular such that the one or more keys are non-rotatable relative to the rotor arm.

11. The extendable rotor arm for a mining machine as set forth in claim 9, wherein at least part of an internal surface of the one or more keys and part of an external surface of the rotor arm are non-circular such that the one or more keys are non-rotatable relative to the rotor arm.

12. The extendable rotor arm for a mining machine as set forth in claim 9, wherein the one or more keys are in the form of a key sleeve fitted over a substantially conical portion of the rotor arm.

13. The extendable rotor arm for a mining machine as set forth in claim 12, wherein the key sleeve is non-rotatable relative to the rotor arm.

14. The extendable rotor arm for a mining machine as set forth in claim 2, wherein the non-circular external portion defines at least one substantially flat surface.

15. The extendable rotor arm for a mining machine as set forth in claim 2, wherein all surfaces of the non-circular external portion are curved.

16. The extendable rotor arm for a mining machine as set forth in claim 1, wherein the sleeve is removably secured to the rotor arm by a shrink fit.

17. The extendable rotor arm for a mining machine as set forth in claim 1, wherein the sleeve is removably secured to the rotor arm by bolts.

18. The extendable rotor arm for a mining machine as set forth in claim 1, wherein the sleeve is non-rotatable relative to the rotor arm.

19. The extendable rotor arm for a mining machine as set forth in claim 18, wherein an internal shape of the sleeve and an external shape of the rotor arm over which the sleeve is removably secured are non-circular.

20. The extendable rotor arm for a mining machine as set forth in claim 1, wherein the sleeve is made of stainless steel.

21. The extendable rotor arm for a mining machine as set forth in claim 20, wherein the end portion of the rotor arm is a cast metal.

22. The extendable rotor arm for a mining machine as set forth in claim 1, wherein all points on the internal surface of the internal opening of the rotor arm extension are spaced from all points on an external surface of the sleeve.

23. A mining machine having extendable rotor arms, comprising:

a body;

two or more drive shafts extending from a forward end of the body;

one or more drives for rotating the drive shafts; and a plurality of extendable rotor arms mounted on each of the drive shafts, each rotor arm having an end portion including a distal end portion, a sleeve removably secured on at least part of the end portion remote from the distal end portion, a rotor arm extension having an internal opening in which the sleeve and the end portion of the rotor arm are axially slidably received and nonrotatable, and a seal disposed in a space between an internal surface of the internal opening. of the rotor arm extension and the sleeve.

24. The mining machine as set forth in claim 23, wherein all points on the internal surface of the internal opening of the rotor arm extension are spaced from all points on an external surface of the sleeve.

25. A method of repairing an extendable rotor arm for a mining machine, comprising the steps of:

removing a rotor arm extension of a rotor arm of a mining machine, the rotor arm having an internal opening, from an operating position on a rotor arm in which an end portion of the rotor arm and at least part of a sleeve on the end portion of the rotor arm, the sleeve being disposed on the end portion of the rotor arm at a point remote from a distal end portion of the rotor arm, are disposed inside of the internal opening of the rotor arm extension, the sleeve being separated from an internal surface of the internal opening of the rotor arm extension by a space;

replacing the sleeve on the end portion of the rotor arm with a new sleeve;

replacing the rotor arm extension in the operating position on the rotor arm.

26. The method as set forth in claim 25, wherein a key is attached to the end portion of the rotor arm and mates with a keyway in the rotor arm extension, the method comprising the further step of removing the key and replacing the key with a new key.

27. The method as set forth in claim 26, wherein the new key is larger than the key, and the method comprises the further step of machining the keyway to receive the new key.

* * * * *